US007112153B1

(12) United States Patent
Beu

(10) Patent No.: US 7,112,153 B1
(45) Date of Patent: Sep. 26, 2006

(54) RETRIEVAL DEVICE

(76) Inventor: Jose Mejias Beu, 555 Oaks Lane, Apt. 211, Pompano Beach, FL (US) 33069

( * ) Notice: Subject to any disclaimer, the term of this patent is extended or adjusted under 35 U.S.C. 154(b) by 0 days.

(21) Appl. No.: 11/098,746

(22) Filed: Apr. 4, 2005

(51) Int. Cl.
*A63B 49/00* (2006.01)

(52) U.S. Cl. ..... 473/553

(58) Field of Classification Search ..... 473/553, 473/517, 524, 286, 463; 294/19.2
See application file for complete search history.

(56) References Cited

U.S. PATENT DOCUMENTS

| | | | | |
|---|---|---|---|---|
| 266,598 | A | 10/1882 | Alexander | |
| 2,110,084 | A * | 3/1938 | Heimers | 473/463 |
| 3,989,247 | A * | 11/1976 | Zimmerman | 473/517 |
| 4,114,881 | A | 9/1978 | Norton | |
| 4,210,327 | A | 7/1980 | Schubert | |
| 4,236,271 | A * | 12/1980 | Martino | 15/246 |
| 4,815,738 | A | 3/1989 | DiFranco | |
| 4,993,712 | A | 2/1991 | Urwin | |
| 5,056,786 | A | 10/1991 | Bellettini et al. | |
| 5,333,854 | A | 8/1994 | Woollard et al. | |
| 5,383,661 | A * | 1/1995 | Beck | 473/517 |
| 5,947,850 | A * | 9/1999 | Gray | 473/517 |
| D444,192 | S | 6/2001 | Frizelle | |
| 6,638,177 | B1 | 10/2003 | Wang | |
| 6,719,651 | B1 | 4/2004 | Newey | |

* cited by examiner

*Primary Examiner*—Raleigh W. Chiu
(74) *Attorney, Agent, or Firm*—Malloy & Malloy, P.A.

(57) ABSTRACT

A retrieval device is connected to a racquet and is structured to allow a user to pick a ball up off of the ground without having to bend down to do the same. The retrieval device includes an elongated retrieval member having a stationary section connected to the racquet via an attachment assembly, and a movable section which is disposed in cooperative engagement with a guide assembly, at least a portion of the guide assembly also being connected to the racquet via the attachment assembly. The movable section of the elongated retrieval member is disposable between a storage configuration and a retrieval configuration. More in particular, the storage configuration is at least partially defined by the movable section substantially conforming to a corresponding portion of the head of the racquet, and the retrieval configuration is at least partially defined by the movable section being disposed in a retrieving relation to the ball.

27 Claims, 3 Drawing Sheets

RETRIEVAL DEVICE

BACKGROUND OF THE INVENTION

1. Field of the Invention

The present invention is direct towards a retrieval device structured to be mounted to an extension apparatus to permit a user to pick up an object with little or no bending. In one embodiment, the retrieval device is mounted to the head of a tennis racquet, and is utilized to allow a player to retrieve a tennis ball from the ground without bending down to do the same. Additionally, the retrieval device of the present invention allows a player to pick up a tennis ball and to release the ball for service with one hand.

2. Description of the Related Art

As people live longer, many find they have more time for leisure and turn to athletic activities that may, at times, be somewhat difficult due to advancing age. Among these activities are various sports including some type of ball and a racquet, such as tennis, racquetball, squash, just to name a few. A common element of these sports is the fact that when a player misses an intended shot, the ball ends up on the ground and must be picked up to be placed back into play. Throughout the course of a match, or even a single game, the repeated bending to retrieve the ball may create such additional physical stress on the player that their enjoyment of the sport is significantly diminished, perhaps to the point where the player abandons the sport altogether. This repetitive bending may also be prohibitive to person's having physical limitations for other reasons, such as loss of a limb or limited mobility, that otherwise may be able to enjoy these athletic activities.

To address this problem, several devices have been developed in attempts to assist a player in picking up a ball without bending. One such device utilizes a used tennis ball, which has a lower quadrant removed and a plurality of vertical slits from the open end to above the midline to form a plurality of gripping fingers. The used tennis ball is attached to the end of the handle of a tennis racquet via a mounting unit which is threadedly connected to the handle. The device is placed overtop of a tennis ball which is on the ground, and as pressure is applied, the gripping fingers expand over the tennis ball and are supposed to retain the tennis ball in place so that it may be picked up off of the ground.

While this device may allow a user to pick up a tennis ball from the ground, it has several inherent disadvantages. To begin, the handle of a modern tennis racquet typically comprises a hollow configuration having the open end covered by a thin plastic cap or endpiece. As such, it is questionable whether the above device can be securely attached to the handle in the proposed manner, and even if the device can be secured, the racquet, at least the cap or endpiece, will be irreparably damaged in the process. In addition, the above device is bulky and impacts the weight and balance of the racquet, which are precise design elements of a modern tennis racquet, thereby affecting the performance of the racquet. Also, this device is positioned on the racquet such that it physically interferes with the player during use, and is aesthetically unappealing. Furthermore, such a device will need to be removed to store the racquet in a standard case, however, repeated removal and reinstallation of such a device will only serve to exacerbate the problem with regard to securing the device and damage to the racquet. Another disadvantage of such a handle mounted device is that the player must release their grip of the racquet, grasp it by the head portion, pick up the ball, and then readjust their grip on the racquet to resume play.

Another device, also structured to be attached to the handle of a racquet, comprises a plurality of flexible petals positioned around a ball receiving recess. The petals include nap catching pins which project into the recess. When this device is forced over a tennis ball, the petals expand outwardly allowing the ball into the recess, and the nap catching pins are elastically forced into the nap of the ball to hold it in the recess so it may be lifted off the ground. Aside from the problems of a handle mounted device, as noted above, the nap catching pins add the further disadvantage of damaging the tennis ball by repeatedly picking up the ball by the nap.

Several other devices have been developed which encompass various arrangements of flexible arms or pins to pick up a tennis ball, all of which suffer the disadvantages of such handle mounted devices, as noted above. Several other devices have been developed which comprise some variation of a hook and loop type of fastener attached to the handle of a racquet to grip the ball to be picked up, some of these device being structured to be lightweight and unobtrusive so as to overcome at least some of the foregoing disadvantages of such handle mounted devices, however, each of these devices still result in damage to the ball by repeatedly lifting the ball by the nap.

Thus, it would be beneficial to provide an improved retrieval device to be mounted to a racquet having negligible impact on the weight and balance of the racquet, thereby maintaining its design performance characteristics. Additionally, it would be helpful for such an improved retrieval device to be structured to be mounted to a racquet in a physically and aesthetically unobtrusive manner. A further advantage may be realized from such an improved retrieval device by providing a device which may be attached and detached to a racquet without damage thereto. Also, it would be preferable for such an improved retrieval device to permit a ball to be picked up without damaging the ball in the process. Any such improved retrieval device should further be structured so as to permit a racquet to be stored in a standard storage case without detaching the device from the racquet. Another beneficial feature for such an improved retrieval device would be to permit the device to be operated by a player without requiring the player to release their grip on the handle of the racquet.

SUMMARY OF THE INVENTION

As noted above, the present invention is directed to a retrieval device structured to engage an extension apparatus to allow a user to pick up an object with little or no bending. In at least one embodiment, the retrieval device is structured to be mounted to the head of a tennis racquet to permit a player to pick up a tennis ball from the ground without bending down to retrieve the ball.

The retrieval device of the present invention comprises an elongated retrieval member, the elongated retrieval member having a stationary section structured to be mounted to the head of the tennis racquet, or other extension apparatus. Additionally, the elongated retrieval member also includes a movable section. More in particular, the movable section of the elongated retrieval member is disposable between a storage configuration and a retrieval configuration, relative to the head of the tennis racquet.

In one embodiment, the storage configuration is at least partially defined by the elongated retrieval member disposed in substantial conformance with a corresponding portion of the head of the tennis racquet. Specifically, when disposed in the storage configuration, the movable section of the elongated retrieval member is structured to substantially conform to a shape of the corresponding portion of the head of the tennis racquet, which typically comprises an arcuate configuration, such that the retrieval device is physically and aesthetically unobtrusive.

With respect to the retrieval configuration of the movable section of the elongated retrieval member, in one embodiment it is at least partially defined by the movable section being disposed in a retaining relation to the tennis ball. The retrieval configuration is further defined by at least a portion of the movable section extending outwardly from the head of the racquet in the retaining relation to the tennis ball. In one further embodiment, the retaining configuration is defined by the movable section forming a retrieval loop, wherein the retrieval loop is structured to be positionable in a retaining relation to the ball. The retrieval loop of this embodiment is structured such that in the retaining relation, the ball is removably retained between the retrieval loop and the head of the racquet.

At least one embodiment of the retrieval device of the present invention includes a guide assembly structured to cooperatively engage the movable section. The guide assembly comprises a guide track structured such that the movable section is positionable along the guide track. The retrieval device of the present invention may also include an attachment assembly structured to connect the stationary section of the elongated retrieval member and at least a portion of the guide assembly to the head of the racquet, without damaging the racquet or the retrieval device.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

The present invention is directed to a retrieval device, generally as shown at 10, structured to allow a user to pick an object up from the ground with little or no bending required of the user. The retrieval device 10 is adapted to engage an extension apparatus so as to allow the user to reach the object to be picked up without bending, the extension apparatus comprising any of a variety of elongated members such a stick, rod, pole, handle, etc. In at least one embodiment, the retrieval device 10 is structured to engage a racquet as are used in a number of athletic activities including tennis, racquetball, and squash, just to name a few.

In one preferred embodiment, the retrieval device 10 of the present invention is structured to be mounted to the head of a racquet, and in a further preferred embodiment, the retrieval device 10 is mounted to the head of a tennis racquet and is structured to allow a player to pick a tennis ball up off the ground without bending down. An attachment assembly 30 is provided to facilitate mounting the elongated retrieval member 12, or at least portions thereof, to the head of the racquet, or other extension apparatus, the attachment assembly 30 being discussed in further detail below.

Figure 1:
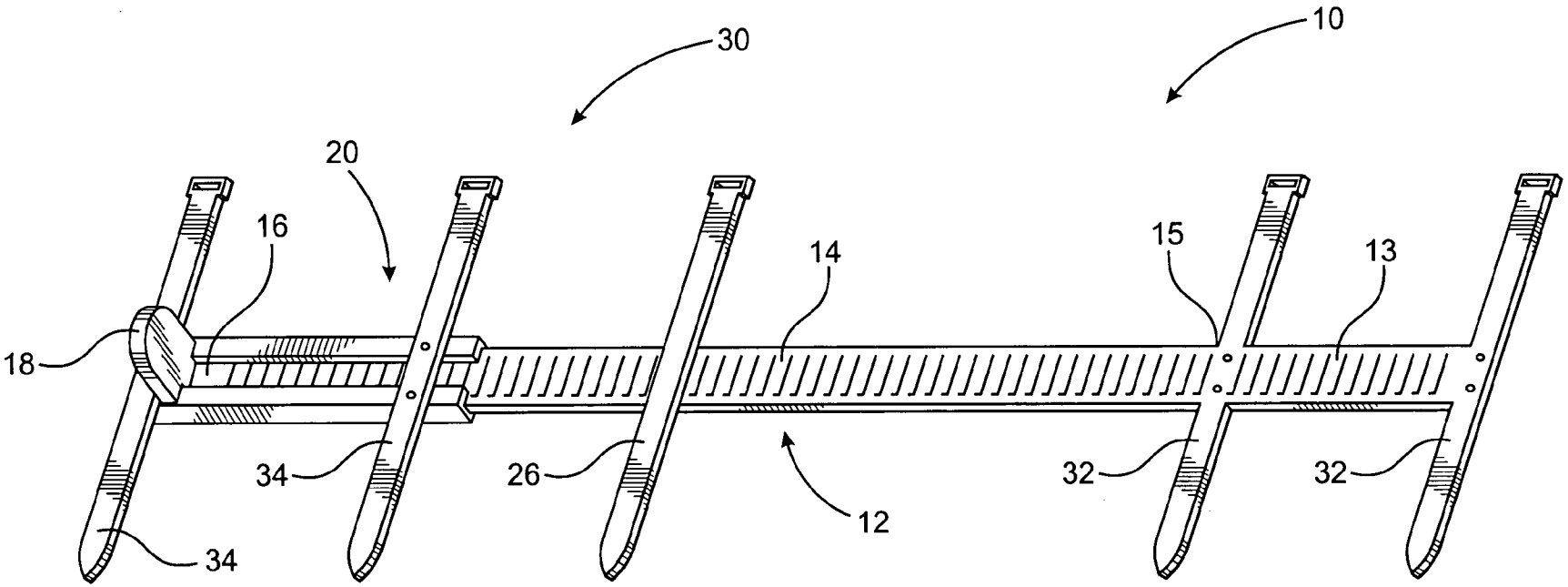
FIG. 1 is a perspective view of one preferred embodiment of a retrieval device of the present invention.

Looking now to FIG. 1, the retrieval device 10 of the present invention comprises an elongated retrieval member 12. The elongated retrieval member 12 may be constructed from any pliable material, such as rubber, plastic, metal and/or metal alloy, just to name a few. As will be appreciated from the disclosure which follows below, in a preferred embodiment, at least a portion of the elongated retrieval member 12 is constructed of a material which is flexible enough to allow quick and easy disposition from a storage configuration to a retrieval configuration, and vise versa.

Figure 2:
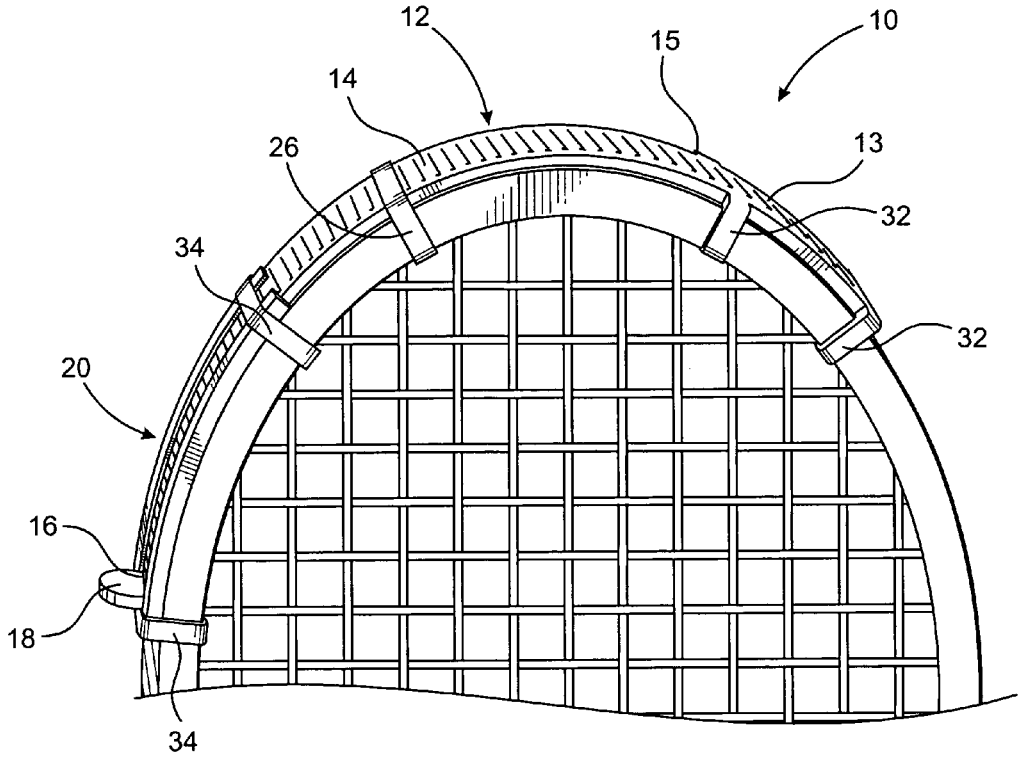
FIG. 2 is a perspective view in partial cutaway of a preferred embodiment of a retrieval device of the present invention mounted to the head of a racquet and disposed in a storage configuration.
Figure 3:
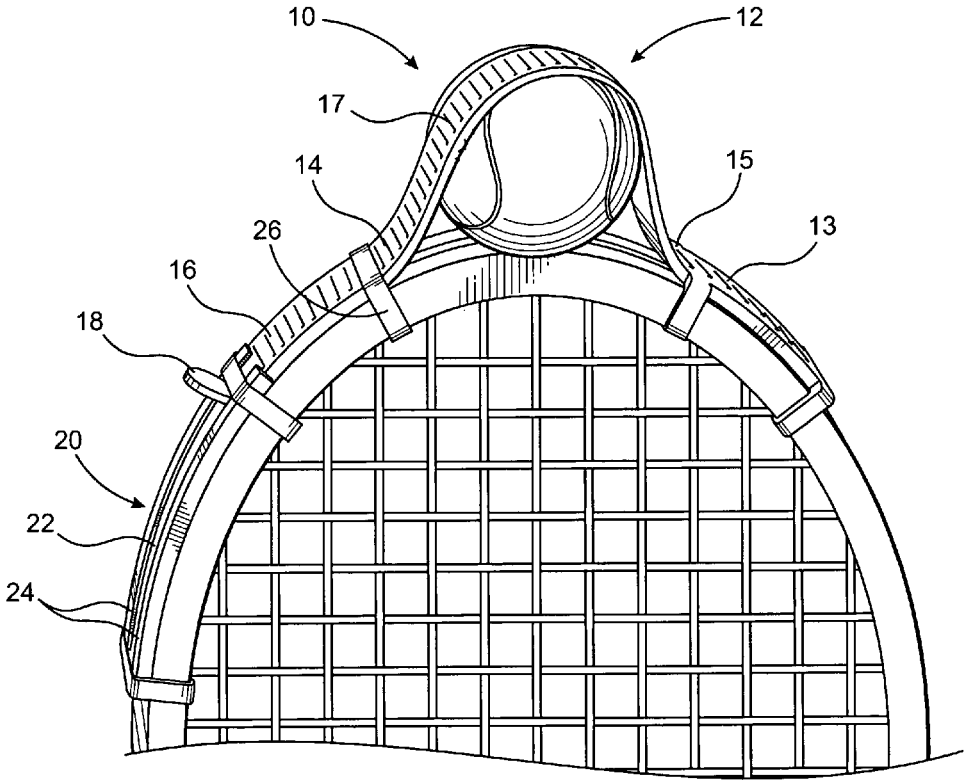
FIG. 3 is a perspective view in partial cutaway of the preferred embodiment of FIG. 2 disposed in a retrieval configuration.
Figure 4:
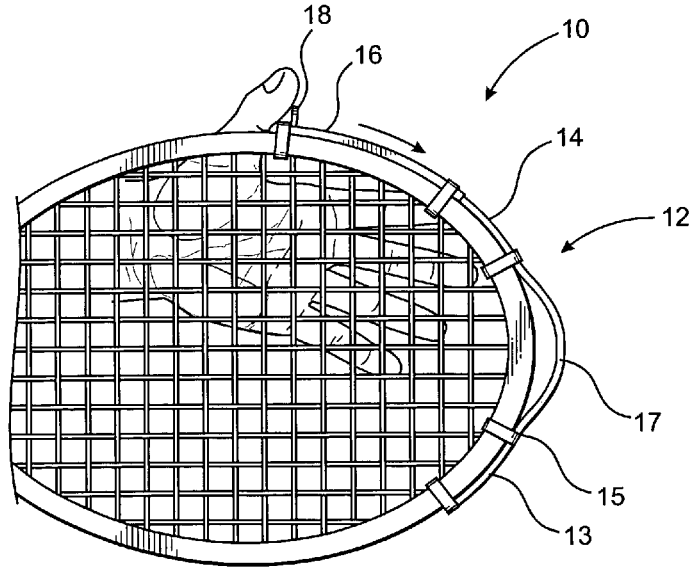
FIG. 4 is a perspective view in partial cutaway of the embodiment of FIG. 2 illustrating operation of an actuation member.

The elongated retrieval member 12 of the present invention comprises a stationary section 13 structured to be mounted to the extension apparatus, such as, for example, the head of a racquet. In one preferred embodiment, the stationary section 13 is structured to be mounted to the head of a tennis racquet and is disposed in substantial conformity with the shape of the corresponding portion of the head of the racquet, as illustrated in FIGS. 2 through 4. Furthermore, the stationary section 13 in a preferred embodiment is structured to comprise a width which is no greater than the width of the head of the racquet, such that the stationary section 13 may be mounted to the racquet in a physically and aesthetically unobtrusive manner. The stationary section 13 is structured to remain substantially immobile relative to the head of the racquet regardless of whether the portion of the elongated retrieval member 12 is disposed in a storage configuration or a retrieval configuration.

More in particular, the elongated retrieval member 12 of the present invention further comprises a movable section 14, and it is a portion of movable section 14 of the elongated retrieval member 12 which is disposable between the storage configuration and the retrieval configuration, as shown in FIGS. 2 and 3, respectively. As indicated above, it is also the movable section 14 of the elongated retrieval member 12 which is constructed of material being flexible enough to allow quick and easy disposition between the storage and retrieval configurations. As with the stationary section 13, the movable section 14 in a preferred embodiment is structured to comprise a width which is no greater than the width of the head of the racquet, such that the movable section 14 may also be mounted to the head of the racquet in a physically and aesthetically unobtrusive manner, as illustrated best in FIG. 2.

The movable section 14 of the elongated retrieval device comprises a fixed end 15 and a free end 16. The fixed end 15 of the movable section 14 is structured and disposed proximate the stationary section 13, and in at least one preferred embodiment, is connected thereto. In one further preferred embodiment, the elongated retrieval member 12 comprises a unitary construction such that the fixed end 15 of the movable section 14 is integrally connected to the stationary section 13, as best illustrated in FIG. 1. The free end 16 of the movable section 14 of the elongated retrieval member 12 is disposed opposite the fixed end 15 along a length of the movable section 14, as illustrated throughout the figures.

At least one embodiment of the retrieval device 10 of the present invention further comprises a guide assembly 20. The guide assembly 20 is structured to engage the extension apparatus and cooperatively engage the movable section 14 of the elongated retrieval member 12. In one preferred embodiment, the guide assembly 20 is structured to be mounted to the head of a racquet and substantially retained in position relative thereto by the attachment assembly 30 which, as before, will be discussed in further detail below. Also, as above with respect to the stationary and movable sections 13 and 14, the guide assembly 20 is preferably structured to comprise a width which is no greater than the width of the head of the racquet, such that the guide assembly 20 may also be mounted to the racquet in a physically and aesthetically unobtrusive manner. In a further preferred embodiment, the guide assembly 20 is structured to be mounted to the head of a tennis racquet and disposed in substantial conformity with the shape of the corresponding portion of the head of the racquet, as illustrated in FIGS. 2 through 4.

The guide assembly 20 is further structured to facilitate the disposition of the movable section 14 between the storage configuration of FIG. 2 and the retrieval configuration illustrated in FIG. 3. In particular, the guide assembly 20 of the present invention comprises a guide track 22 which, in a preferred embodiment, also comprises an elongated configuration, as shown in the figures. Additionally, the guide assembly 20 further comprises at least one guide rail 24 structured to securely yet movably retain at least a portion of the movable section 14 in cooperative engagement with the guide assembly 20. In a preferred embodiment, the guide assembly 20 comprises a plurality of guide rails 24 being structured to securely yet movably retain at least a portion of the movable section 14 in cooperative engagement with the guide assembly 20, as best illustrated in FIG. 3.

At least a portion of the movable section 14 of the elongated retrieval member 12 of the present invention is positionable along the guide assembly 20. In one preferred embodiment, the free end 16 of the moveable section 14 is movingly positionable along the guide track 22, and in one further preferred embodiment, the free end 16 is slidingly positionable along the guide track 22. To facilitate movably positioning the free end 16 of the movable section and, thus, facilitate disposition of the movable section 14 between the storage and retrieval configurations, an actuation member 18 is disposed in an operative relation with the movable section 14. In at least one embodiment, the actuation member 18 is connected to the free end 16 to facilitate movably positioning the free end 16 along the guide track 22, as illustrated throughout the figures.

More in particular, and looking to FIG. 4, the actuation member 18 allows a user to apply pressure to the actuation member 18 in the direction of the arrow shown in FIG. 4 to dispose the movable section 14 of the elongated retrieval member 12 into the retrieval configuration of FIG. 3 from the storage configuration of FIG. 2. As will be appreciated, application of pressure to the actuation member 18 in the direction opposite the arrow of FIG. 4 will dispose the movable section 14 from the retrieval configuration of FIG. 3 to the storage configuration of FIG. 2. In addition, FIG. 4 illustrates that the user may apply pressure to the actuation member 18 with the thumb or other part of the hand, however, a user may also use a portion of the foot to apply pressure to the actuation member 18, thereby allowing the user to dispose the movable section 14 between the storage and retrieval configurations without releasing their grip on the handle of the tennis racquet.

As above, the retrieval configuration of the movable section 14 of the elongated retrieval member 12 of the present invention is at least partially defined by the movable section 14 being disposed and positionable in a retrieving relation to an object, such as a tennis ball. In one preferred embodiment, at least a portion of the movable section 14 is structured to extend outwardly from the head of the racquet in the retaining relation to the tennis ball. The retrieving relation is further defined by the free end 16 of the movable section 14 being disposed and positioned along the guide track 22 towards the fixed end 15 such as is, by way of example only, illustrated in FIG. 3. Conversely, the storage configuration is at least partially defined by the free end 16 being positioned along the guide track 22 away from the fixed end 15, as illustrated in FIG. 2.

More in particular, the retrieval configuration is defined by the movable section 14 forming a retrieval loop 17 between the fixed end 15 and the free end 16. Specifically, in one preferred embodiment, the retrieval configuration is defined by the retrieval loop 17 structured to be positionable about a portion of an object to be retrieved, the retrieval loop 17 being further structured to removably retain the object between itself and the extension apparatus to which the retrieval device 10 of the present invention is attached such as is illustrated, once again, by way of example only, in FIG. 3.

The guide assembly 20 in one preferred embodiment further comprises a stabilizing member 28 which is structured to facilitate the formation of the retrieval loop 17 between the fixed end 15 and the free end 16, by at least partially retaining a portion of the movable section 14 in position relative to the head of the racquet, or other extension apparatus, while the movable section 14 is disposed into the retrieval configuration.

Also as stated above, the retrieval device 10 of the present invention further comprises an attachment assembly 30 structured to permit the retrieval device 10 to be mounted to an extension apparatus. The attachment assembly 30 comprises at least one stationary attachment member 32 structured to connect at least the stationary section 13 to the extension apparatus, such as the head of a tennis racquet. Additionally, the attachment assembly 30 comprises at least one guide fastener 34 structured to connect the guide assembly 20 to the head of the racquet. In one preferred embodiment, the attachment assembly 30 comprises a plurality of stationary fasteners 32 and guide fasteners 34, as illustrated in the figures. As further shown in the figures, fasteners 32 and 34 may comprise an elongated configuration structured to be wrapped around the frame at the head of the racquet to connect the stationary section 13 and the guide assembly 20, respectively, thereto. The fasteners 32 and 34 may utilize any of a variety of mechanical connection mechanisms including tongue and groove, ties, clips, snaps, buttons, hook and loop type fasteners, etc.

In one preferred embodiment, the attachment assembly 20 allows connection of the stationary section and the guide assembly 20 to the head of a tennis racquet without damage thereto. In a further preferred embodiment, the attachment assembly 20 is structured to allow for repetitive connection and removal of the retrieval device 10 from the head of the tennis racquet as may be desired by the player, without damage to the racquet, or to the retrieval device 10 itself. Of course, given the physically and aesthetically unobtrusive manner in which the retrieval device 10 of the present invention is installed onto a tennis racquet, little need exists to remove the device 10 once installed as it does not interfere with use during play or storage of the racquet in any standard storage case, once play has been completed. In particular, when disposed in the storage configuration, the elongated retrieval member 12 of the retrieval device is disposed in a substantially conforming relation with the shape of a corresponding portion of the head of the racquet, as best illustrated in FIG. 2, such that the racquet may be stored in any standard storage bag or case.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A retrieval device structured to engage the head of a tennis racquet and to retrieve a tennis ball, the retrieval device comprising:

an elongated retrieval member, said elongated retrieval member having a stationary section structured to be mounted to the head of the tennis racquet, said elongated retrieval member further comprising a movable section, said movable section disposable relative to the head of the tennis racquet between a storage configuration and a retrieval configuration, said storage configuration partially defined by said elongated retrieval member disposed in substantial conformance with a corresponding portion of the head of the tennis racquet, and said retrieval configuration partially defined by said movable section disposed in a retaining relation to the tennis ball.

2. The device as recited in claim 1 further comprising an attachment assembly structured to connect at least said stationary section to the head of the tennis racquet.

3. The device as recited in claim 1 further comprising an actuation member disposed in an operative relation with said movable section.

4. The device as recited in claim 3 wherein said actuation member is structured to facilitate disposition of said movable section between said storage configuration and said retrieval configuration.

5. The device as recited in claim 1 further comprising a guide assembly structured to cooperatively engage said movable section.

6. The device as recited in claim 5 wherein said guide assembly comprises a guide track.

7. The device as recited in claim 6 wherein said movable section is positionable along said guide track.

8. The device as recited in claim 7 wherein said guide assembly further comprises at least one guide rail, said guide rail structured to securely yet movably retain said movable section in said cooperative engagement with said guide assembly.

9. The device as recited in claim 7 wherein said guide assembly further comprises a plurality of guide rails, said plurality of guide rails structured to securely yet movably retain said movable section in said cooperative engagement with said guide assembly.

10. The device as recited in claim 1 wherein said retrieval configuration is further defined by at least a portion of said movable section extending outwardly from the head of the racquet in said retaining relation to the tennis ball.

11. A retrieval device structured to engage an extension apparatus and to retrieve an object, the retrieval device comprising:

an elongated retrieval member, said elongated retrieval member having a stationary section structured to be mounted to the extension apparatus, said elongated retrieval member further comprising a movable section having a free end and a fixed end, said movable section disposable between a storage configuration and a retrieval configuration, a guide assembly structured to engage said movable section in a cooperative arrangement, said guide assembly comprising a guide track, and an attachment assembly structured to connect said stationary section and said guide assembly to the extension device.

12. The device as recited in claim 11 wherein at least said free end of said movable section is movably positionable along said guide track.

13. The device as recited in claim 12 wherein at least said free end of said movable section is slidingly positionable along said guide track.

14. The device as recited in claim 12 wherein said retrieval configuration is partially defined by said free end of said movable section positioned along said guide track towards said fixed end.

15. The device as recited in claim 14 wherein said retrieval configuration is further defined by said movable section forming a retrieval loop between said free end and said fixed end wherein said retrieval loop is structured to be disposed in a retaining relation to the object.

16. The device as recited in claim 15 wherein said retrieval loop is further structured such that the object is removably retained between said retrieval loop and the extension apparatus.

17. The device as recited in claim 12 wherein said storage configuration is partially defined by said free end of said movable section positioned along said guide track away from said fixed end.

18. A retrieval device structured to engage the head of a racquet and to retrieve a ball, the retrieval device comprising:

an elongated retrieval member, said elongated retrieval member having a stationary section structured to engage the head of the racquet, said elongated retrieval member further comprising a movable section having a free end and a fixed end, said movable section disposable between a storage configuration and a retrieval configuration, an actuation member disposed in an operative relation with said movable section and structured to facilitate disposition of said movable section between said storage configuration and said retrieval configuration, a guide assembly structured to cooperatively engage said movable section, said guide assembly comprising a guide track having a plurality of guide rails structured to retain said movable section in said cooperative engagement with said guide assembly, and an attachment assembly structured to connect said stationary section and at least a portion of said guide assembly to the head of the racquet.

19. The device as recited in claim 18 wherein said free end of said movable section is movably positionable along said guide track.

20. The device as recited in claim 19 wherein said free end of said movable section is slidingly positionable along said guide track.

21. The device as recited in claim 19 wherein said actuation member is connected to said free end to facilitate movably positioning said free end along said guide track.

22. The device as recited in claim 18 wherein said retrieval configuration is partially defined by said free end of said movable section positioned along said guide track towards said fixed end.

23. The device as recited in claim 22 wherein said retrieval configuration is further defined by said movable section forming a retrieval loop between said free end and said fixed end.

24. The device as recited in claim 23 wherein said retrieval loop is structured to be positionable in a retaining relation to the ball.

25. The device as recited in claim 23 wherein said retrieval loop is structured such that the ball is removably retained between said retrieval loop and the head of the racquet.

26. The device as recited in claim 23 wherein said guide assembly further comprises a stabilizing member structured to facilitate formation of said retrieval loop between said free end and said fixed end.

27. The device as recited in claim 18 wherein said retrieval configuration is partially defined by at least a portion of said movable section extending outwardly from the head of the racquet in said retaining relation to the ball.

* * * * *